US006260978B1

(12) United States Patent
St. John

(10) Patent No.: US 6,260,978 B1
(45) Date of Patent: Jul. 17, 2001

(54) BATTERY POWER AND LIGHT BELT

(76) Inventor: Kenneth E. St. John, 8841 Richard Rd., Utica, OH (US) 43080

( * ) Notice: Subject to any disclaimer, the term of this patent is extended or adjusted under 35 U.S.C. 154(b) by 0 days.

(21) Appl. No.: 09/564,168

(22) Filed: May 3, 2000

(51) Int. Cl.[7] ..... F21W 121/06

(52) U.S. Cl. ..... 362/108; 362/105; 362/106; 362/110

(58) Field of Search ..... 362/108, 103, 362/110, 253, 105, 106

(56) References Cited

U.S. PATENT DOCUMENTS

| | | | | |
|---|---|---|---|---|
| D. 279,424 | * | 7/1985 | Leiserson et al. | D2/381 |
| 1,584,276 | * | 5/1926 | Coulter | 362/105 |
| 2,304,367 | | 12/1942 | Meyer et al. | 224/5 |
| 3,274,476 | | 9/1966 | Wildum | 320/2 |
| 4,298,913 | * | 11/1981 | Lozar | 362/103 |
| 4,523,258 | * | 6/1985 | Morse et al. | 362/108 |
| 5,024,360 | | 6/1991 | Rodriguez | 224/215 |
| 5,183,324 | * | 2/1993 | Thomas | 362/108 X |
| 5,211,321 | | 5/1993 | Rodriguez | 224/215 |
| 5,535,106 | * | 7/1996 | Tangen | 362/108 |
| 5,680,026 | | 10/1997 | Lueschen | 320/2 |

FOREIGN PATENT DOCUMENTS 2270832 3/1994 (GB) .

* cited by examiner

*Primary Examiner*—Laura K. Tso
(74) *Attorney, Agent, or Firm*—John L. Gray; Kegler, Brown, Hill & Ritter

(57) ABSTRACT

A belt having rechargeable batteries thereon and connected to a light to be worn on the cap of the hunter as well as a flood light to be carried by the hunter and also a third light which may be used to illuminate the walking area. The first two lights provide different levels of illumination.

4 Claims, 4 Drawing Sheets

BATTERY POWER AND LIGHT BELT

BACKGROUND OF THE INVENTION

Raccoon hunting, popularly known as coon hunting, is a sport which is engaged in by a large number of hunters hunting at night with the aid of especially trained dogs to find and tree the quarry. After the quarry is treed, it is shot by means of a rifle used by the coon hunter. There is no convenient means for providing light as needed for this operation. Some hunters carry flashlights but this is awkward because they need both hands to handle the rifle and therefore cannot adequately illuminate the target.

BRIEF SUMMARY OF THE INVENTION

Applicant's invention provides a belt worn by the hunter containing rechargeable batteries and which may be connected to primary sources of light. One is a light which may be attached to the cap of the hunter so it may be used to illuminate the target when the hunter is firing his weapon. Also a flood light is provided which may be carried on the belt of the hunter and used as needed. The invention also includes a third light which may be used to illuminate the ground in the immediate area where the hunter is walking. The batteries are readily rechargeable and each of the first two lights are provided with two different quantities of battery power which may be controlled by switches so as to vary the amount of illumination.

It is therefore an object of this invention to provide a battery power and light belt which is especially adapted for use in night time hunting of raccoons.

This, together with other objects of the invention, will become apparent from the following detailed description of the invention and the accompanying drawings.

DETAILED DESCRIPTION OF THE INVENTION

Figure 1:
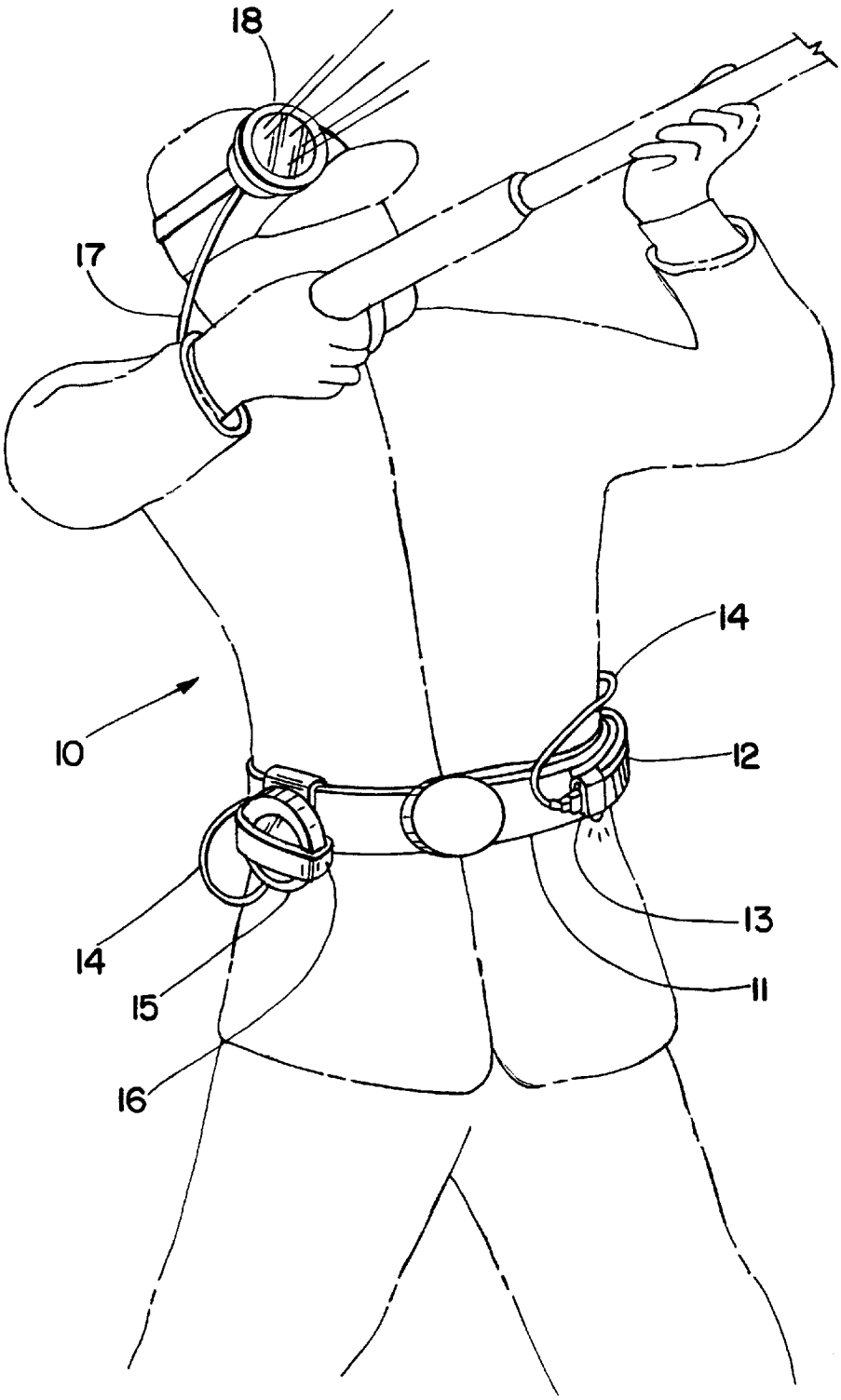
FIG. 1 is a perspective view of the hunter utilizing the invention.

Referring now to FIG. 1, the hunter shown at 10 is shown wearing the belt 11 with the battery pack 12 and the connection at 13 of a cable 14 connected to the flood light 15 which may be carried in an appropriate carrier 16 on the belt 11. The other end of the battery pack (not shown) is connected by a cable 17 to the light 18 attached to the hat of the hunter 10.

Figure 2:
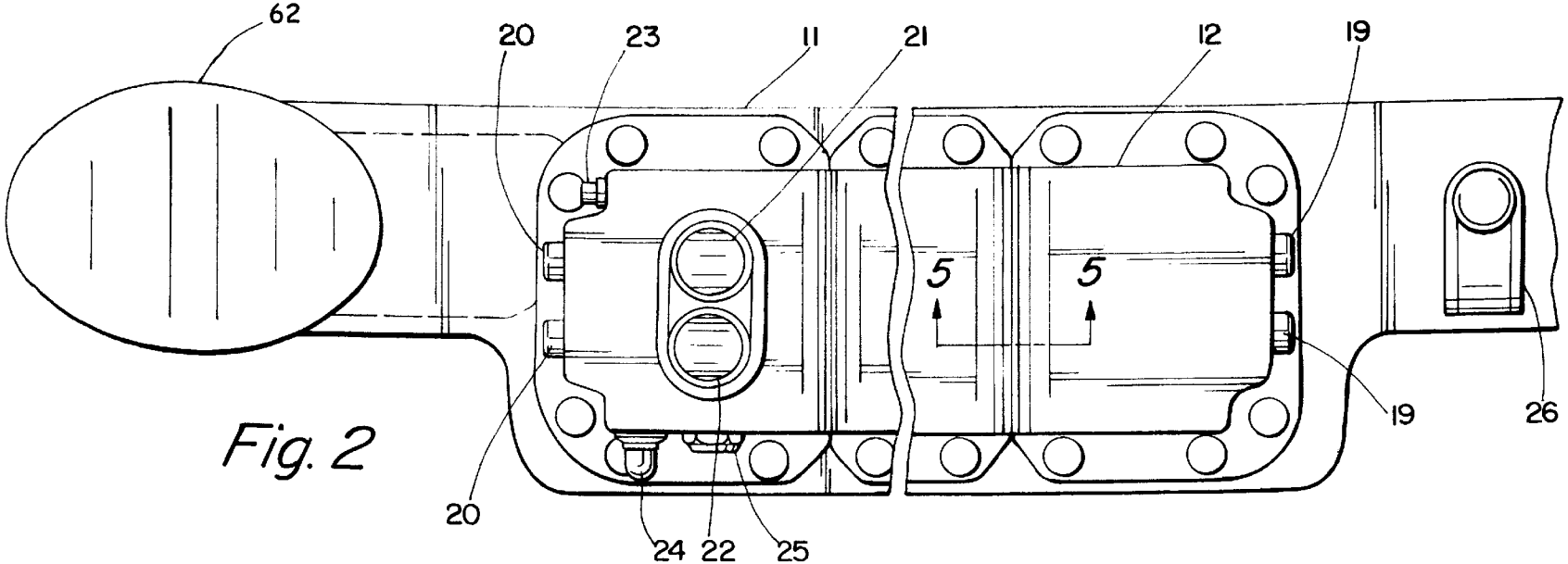
FIG. 2 is a plan view of the belt portion of the invention.

Referring now to FIG. 2, the belt buckle 62 of the belt 11 is shown as is the battery pack 12. The connections for the cable 17 to the light 18 are shown at 19—19 and the connection for the cable 14 for the light 15 are shown at 20—20. Switches 21 and 22 are preferably three way switches as will be apparent from the wiring diagram in FIG. 10. Switch 23 controls walking light 24 and a receptacle 25 is provided for recharging the batteries. A hook 26 is provided to support the cable 17.

Figure 3:
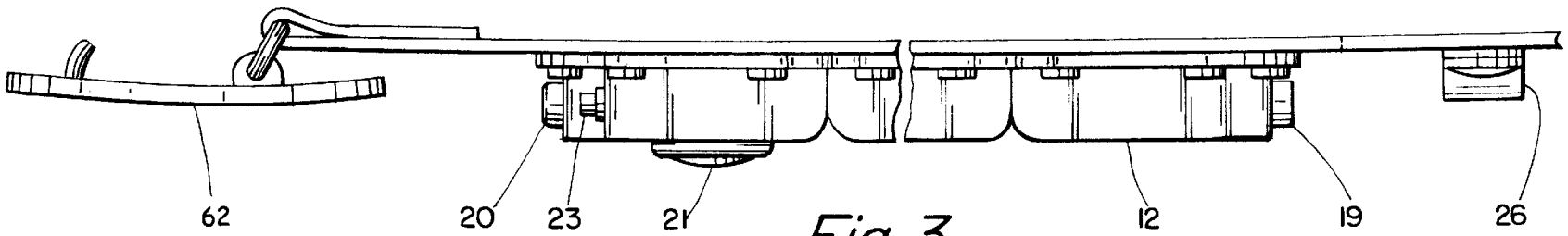
FIG. 3 is a side elevation of one side of FIG. 2.
Figure 4:
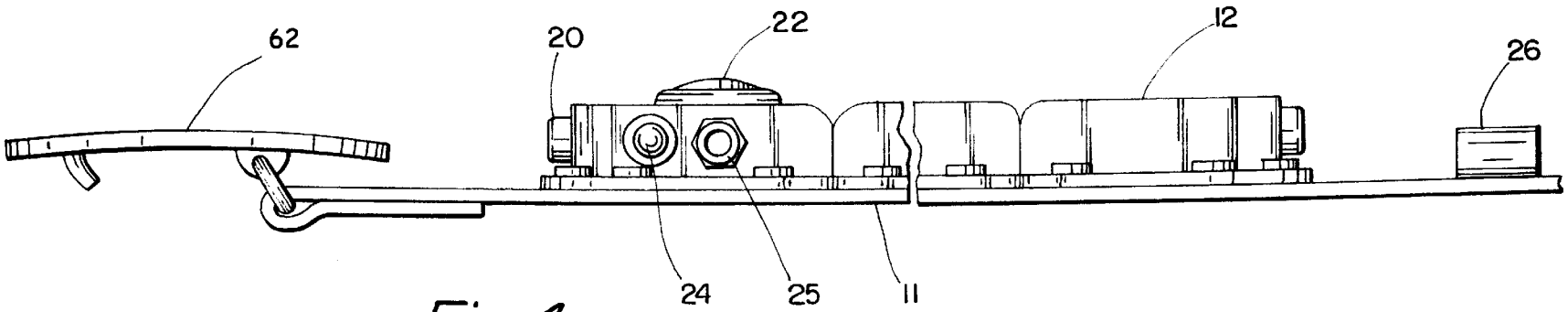
FIG. 4 is a side elevation of the other side of FIG. 2.

FIGS. 3 and 4 show the details of the side elevations of FIG. 2.

Figure 5:
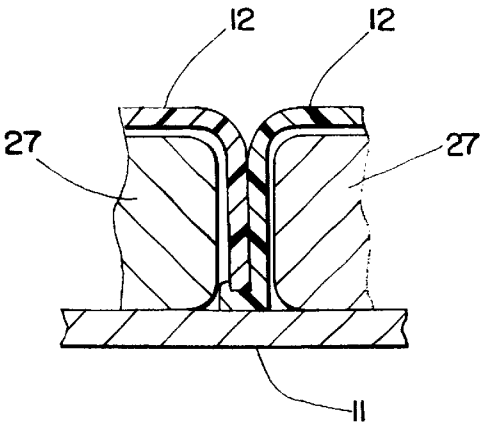
FIG. 5 is a sectional view showing the battery compartments from one side.

FIG. 5 is sectional detail of battery holders 12—12 and the manner in which they are attached together and the manner in which they are attached to the belt 11 holding the batteries 27—27.

Figure 6:
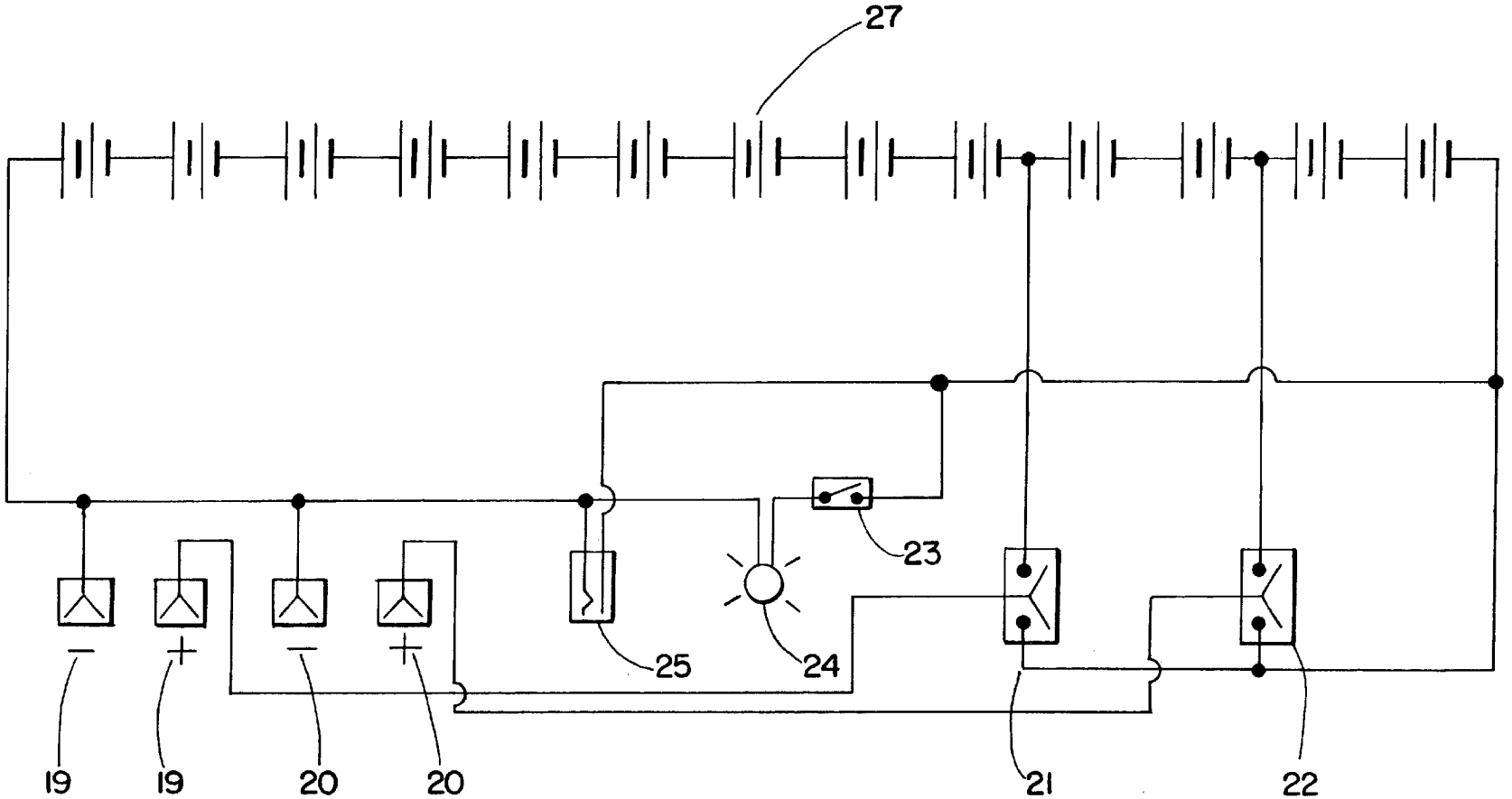
FIG. 6 is a wiring diagram of the system.

Referring now to FIG. 6, the batteries 27—27 are shown in the wiring diagram as are the outlets 19—19 and outlets 20—20. The recharging connection 25 is shown as is the walk light 24 and its switch 23. Switches 21 and 22 are shown as three position switches. In the center position they are off and unconnected. In one position the switch connects a certain number of the batteries and in the second position, it connects all of the batteries to the respective outlet.

Thus it can be seen that there is provided a battery and light pack especially adapted for raccoon hunting which provide a light that is worn on the cap of the hunter and which has two levels of illumination associated with it. A flood light having two levels of illumination to provide more light as needed for other purposes and a walking light which enables the hunter to see what is underfoot in the dark in the forest where he is hunting are also provided.

While this invention has been shown and described with respect to a detailed embodiment thereof, it will be understood by those skilled in the art that various changes in form and detail thereof may be made without departing from the scope of the claims of the invention.

What is claimed is:

1. A belt having two ends and being provided with means at each end to connect said ends together, a plurality of adjacent containers on said belt, each of said containers being of a size and shape to hold one or more rechargeable batteries, means for electrically connecting said batteries together in series, a first light source means for connecting a first group of said batteries to said first light source, a first switch for interrupting the flow of electricity from said first group of batteries to said first light source, means for connecting a second group of said batteries to said first light source, and a second switch for interrupting the flow of electricity from said second group of batteries to said first light source.

2. The belt of claim 1 additionally comprising a second light source means for connecting a third group of said batteries to said second light source, a third switch for interrupting the flow of electricity from said third group of batteries to said second light source, means for connecting said second group of said batteries to said second light source, and a fourth switch for interrupting the flow of electricity from said second group of batteries to said second light source.

3. The belt of claim 1 additionally comprising a third light source, means for connecting said second group of batteries to said third light source, and a fifth switch for interrupting the flow of electricity from said second group of batteries to said third light source.

4. The belt of claim 1 having in addition means for connecting said batteries to a device for recharging said batteries.

* * * * *